US007117796B1

(12) United States Patent
Bogle et al.

(10) Patent No.: US 7,117,796 B1
(45) Date of Patent: Oct. 10, 2006

(54) IGNITER FOR EXOTHERMIC TORCH ROD

(75) Inventors: Kurt D. Bogle, Virigina Beach, VA (US); Allen M. Bryant, Viriginia Beach, VA (US); Steve P. D'Arche, Odon, IN (US); Michael H. Jones, Bedford, IN (US); Vic N. Makximenko, Bedford, IN (US); Frank L. Soltis, Martinsville, IN (US); Brent T. Voigtschild, Bedford, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/326,674

(22) Filed: Dec. 29, 2005

(51) Int. Cl.
*C06C 5/00* (2006.01)

(52) U.S. Cl. ..... 102/275.6; 102/200; 102/204

(58) Field of Classification Search ..... 102/275.6, 102/200, 204, 275.11
See application file for complete search history.

(56) References Cited

U.S. PATENT DOCUMENTS 831,947 A * 9/1906 Graeme et al. ..... 102/204
5,365,851 A * 11/1994 Shaw ..... 102/275.6
5,372,069 A * 12/1994 Hart et al. ..... 102/288

* cited by examiner

*Primary Examiner*—Stephen M. Johnson
*Assistant Examiner*—Gabriel J. Klein
(74) *Attorney, Agent, or Firm*—Michael P. Stanley

(57) ABSTRACT

An igniter's housing is bored continuously there through to define, in succession, several bore regions. A firing pin, slidingly fit in the first bore region, terminates in a tip that protrudes into a primer-filled second bore region when the firing pin is fully seated in the first bore region. An air-filled third bore region follows the second bore region. An open-ended cup is fitted substantially in and sealed to the fourth bore region with the cup's closed end being structurally weakened at a portion thereof. A bored out slug of pyrotechnic material is fitted in the cup.

19 Claims, 2 Drawing Sheets

IGNITER FOR EXOTHERMIC TORCH ROD

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates generally to exothermic torch rods, and more particularly to an igniter for a torch rod that does not require any power for use in or out of water.

(2) Description of the Prior Art

As is known in the art, oxygen-based cutting-torch (or "torch rod") systems use hollow steel tubes that house hollow or solid steel wires or rods therein. An igniter is used to ignite one end of the steel wires or rods which burn to form a cutting-torch. Current ignition methods include exposing the ends of the steel wires or rods to high current, placing the ends of the steel wires or rods in a smoldering cardboard (punk) tube, or depositing a molten metallic product on the ends of the wires or rods while exposing same to a supply of oxygen. However, the high current and smoldering punk tube ignition systems are either useless, unreliable or, at the very least, difficult to use in underwater environments. Currently available ignition systems that produce a molten metallic product use a powdered energetic compound and a chemical catalyst that are separated from one another until ignition is required. However, powdered energetic compounds are not reliable and have a limited shelf life.

SUMMARY OF THE INVENTION

Accordingly, it is an object of the present invention to provide an igniter for use with an exothermic torch rod.

Another object of the present invention is to provide a reliable, non-electric igniter adapted for use with a torch rod in underwater applications.

Other objects and advantages of the present invention will become more obvious hereinafter in the specification and drawings.

In accordance with the present invention, a housing of an igniter is bored continuously there through to define, in succession, a first bore region that begins at the housing's first end, a second bore region, a third bore region, and a fourth bore region that terminates at a second end of the housing.

A firing pin is slidingly fit in the first bore region and extends from the first end of the housing. The firing pin terminates in a tip that protrudes into the second bore region when the firing pin is fully seated in the first bore region. A primer is press-fit in the second bore region. A cup having an open end and a closed end is fitted substantially in and sealed to the fourth bore region with the closed end being substantially coincident with the second end of the housing. The closed end is structurally weakened at a portion thereof. A slug of pyrotechnic material is fitted in the cup. The slug has a bore that is formed continuously there through and that is substantially centrally aligned with the third bore region. Upon ignition, the pyrotechnic material converts at least partially to molten metallic reaction products.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DESCRIPTION OF THE PREFERRED EMBODIMENT(S)

Figure 1:
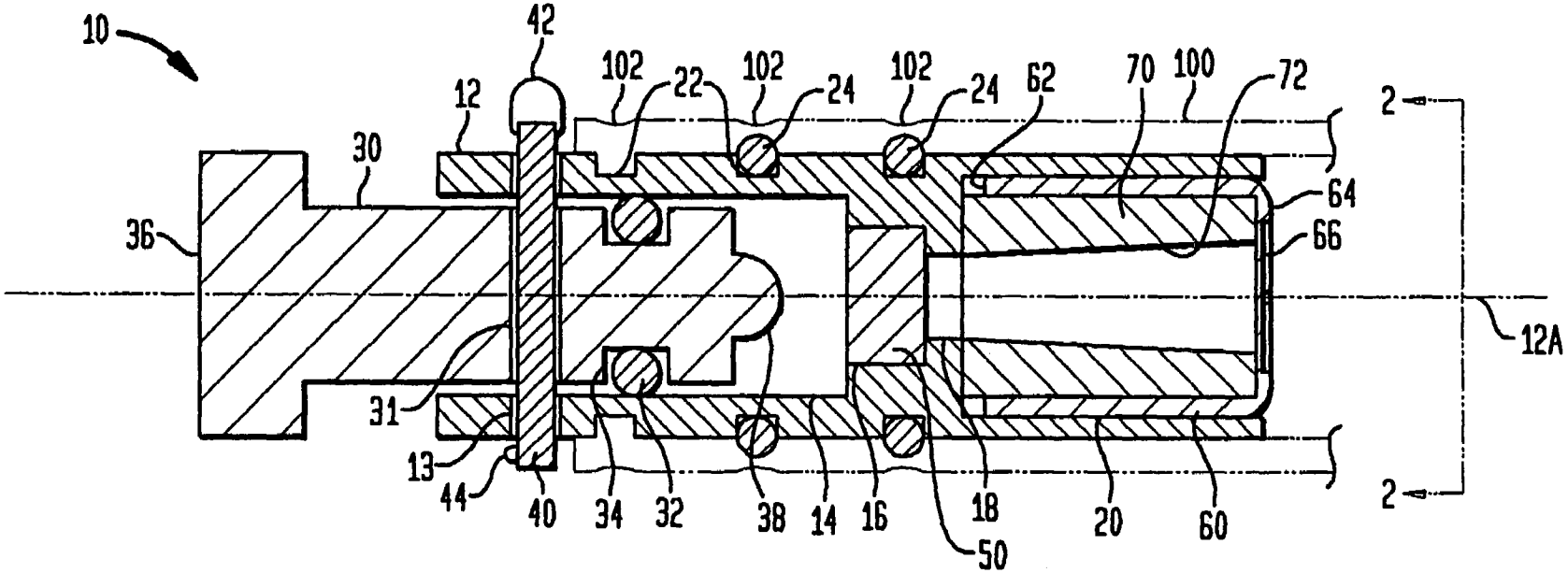
FIG. 1 is a cross-sectional view of an igniter for use with a torch rod in accordance with an embodiment of the present invention.

Referring now to the drawings, and more particularly to FIG. 1, an igniter in accordance with an embodiment of the present invention is shown and is referenced by numeral 10. The igniter 10 is shown installed in the aft end of a conventional torch rod 100 which is shown in phantom to indicate that torch rod 100 is not a part or limitation of the present invention. Such torch rods are well known in the art and will not be described further herein.

The igniter 10 has a rigid body or housing 12 (e.g., made of a metal such as stainless steel, a plastic, a composite, etc.) that is bored there through to define several different sized regions aligned along a central axis 12A. Typically, each bore region is cylindrical owing to the simplicity of manufacturing same in this fashion. A first bore region 14 houses a firing pin 30 (e.g., made of a metal such as stainless steel, a plastic, a composite, etc.) such that firing pin 30 can slide therein as in a piston-cylinder relationship. An o-ring 32 can be provided in an annular recess 34 in order to form a seal between firing pin 30 and first bore region 14. Such a seal is important when the igniter 10 is used in underwater environments.

The firing pin 30 terminates at one end in a strike head 36 that remains outside of the housing 12. At an opposite end of the firing pin 30, the firing pin terminates in a protruding tip 38 that remains in the housing 12 and is aligned with a second bore region 16. The second bore region 16 has a smaller diameter than the first bore region 14 so that only a tip 38 will extend into the second bore region 16 when the firing pin 30 is fully seated in the first bore region 14.

Illustrated in a "pre-use" state, the firing pin 30 is positioned in first bore region 14 such that the tip 38 is spaced apart from the second bore region 16. To lock the firing pin 30 in this pre-use state, any of a variety of locking mechanisms can be used. For example, a safety pin 40 can be provided and extend through aligned holes 13 and 31 in the housing 12 and the firing pin 30, respectively. The safety pin 40 can be retained in holes 13 and 31 by means of a pull ring 42 on one end of the safety pin and a spring-loaded ball 44 at the other end of the safety pin. When the igniter 10 is to be used, the safety pin 40 is removed by pulling on the ring 42 until the spring force operating on the ball 44 is overcome.

The second bore region 16 is filled with a percussion primer material 50. Typically, the primer material 50 is press-fit into the second bore region 16. While a variety of percussion primer materials could be used, a commercially-available example of such a material is a mixture of potassium chlorate and lead sulfocyanate available as M42C2-793 primer.

On the other side of the second bore region 16 is a third bore region 18 that is air filled. When the primer material 50 is press-fit in the second bore region 16, the third bore region 18 is typically smaller in diameter than second bore region 16 in order to define a ledge or stop for the primer material 50. When the primer material 50 is ignited, the third bore region 18 forms a flash-through hole for the combustion product of the primer material.

Adjacent the third bore region 18 is a larger-diameter fourth bore region 20. Mounted in the fourth bore region 20 is an assembly that includes a cup-shaped element 60 and a hollow slug 70 of a pyrotechnic material that, when burning, is at least partially converted to molten metallic reaction products. When installed in and sealed to the housing 12, (e.g., using an epoxy seal, a threaded seal and/or o-ring seal), the cup-shaped element 60 forms both a holder and waterproof seal for the slug 70. The cup-shaped element 60 can be made from a plastic, composite, or metal without departing from the scope of the present invention. By way of illustrative example, the remainder of the description assumes that the cup-shaped element 60 is made from aluminum.

Figure 2:
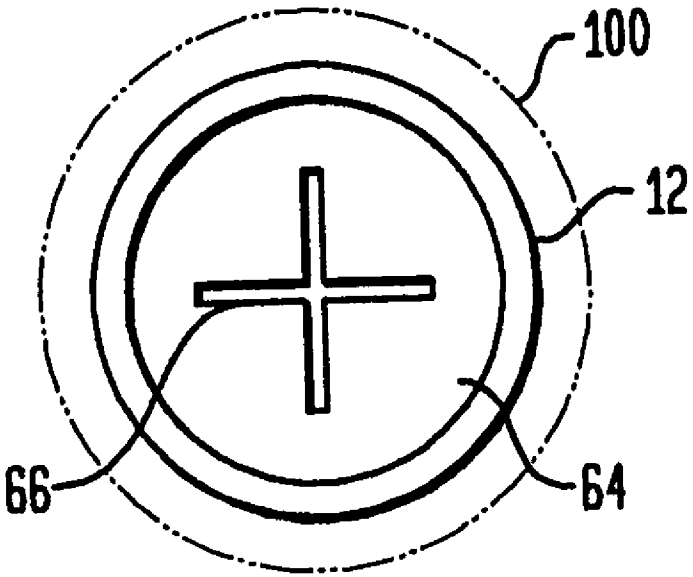
FIG. 2 is an end view of the igniter taken along line 2—2 in FIG. 1.

The element 60 has an open end 62 for receiving the slug 70 and a closed end 64 that has been structurally weakened in some fashion. In general, the closed end 64 is structurally weakened such that the weakened portion fails when exposed to the molten metallic reaction products produced when the slug 70 burns. For example, when the element 60 is made from aluminum, the closed end 64 can be stamped with a design 66 (e.g., a cross or "X" as shown in FIG. 2) such that the stamped design is reduced in thickness (i.e., is structurally weaker) with respect to the unstamped portion of the closed end 64. Other stamp designs or forms of structural weakening known to those skilled in the art can be used without departing from the scope of the present invention.

The slug 70 is a pre-pressed or molded pyrotechnic composition. While a variety of pyrotechnic compositions can be used without departing from scope of the present invention, a unique composition that provides good results (i.e., low gas production of reaction products, ease of ignition, high thermal stability, non-toxic, and good production of molten metallic reaction products) will be described herein. Rounding to the nearest tenth of a percent, this exemplar composition comprises approximately 48.0 weight percent iron oxide, approximately 31.3 weight percent titanium, approximately 17.6 weight percent zirconium, and approximately 2.9 weight percent of a binder such as a polyacrylic rubber binder. The term "approximately" here is meant to cover deviations of ±2% for each listed component without departing from the scope of the present invention.

The slug 70 is formed with a centrally-positioned hollow core 72 along the length thereof. The core 72 can be cylindrical with a constant diameter or, more preferably, can diverge or increase in diameter (as shown) between the open end 62 and the closed end 64 of the cup-shaped element 60. The slug 70 can be formed such that the core 72 aligns with and is sized to substantially match the third bore region 18 where it is adjacent thereto.

The slug 70 can further be sized such that it extends slightly from the open end 62 of the cup-shaped element 60 as shown. In this way, when the element 60 with the slug 70 disposed therein is fitted into the fourth bore region 20, the slug will positively seat fully in the fourth bore region 20 to thereby prevent any unwanted movement thereof when the element 60 is sealed to the fourth bore region 20.

In order to install the igniter 10 in the torch rod 100, the housing 12 can be provided with one or more (e.g., three are shown in FIG. 1) open annular channels 22 that can form locations where torch rod 100 is crimped at location 102 onto the housing 12. Additionally or alternatively, o-rings 24 can be provided in one or more of the channels 22 to provide a seal with the inner dimensions of the torch rod 100. The o-rings 24 can be used in place of or in conjunction with the above-described crimping as illustrated.

With the igniter 10 installed in the torch rod 100 as just described, the igniter is ready for use. At the desired time, the safety pin 40 is removed. Note that the presence of o-ring 32 maintains the position of the firing pin 30 after the safety pin 40 is removed. By firmly striking the head 36 in the axial direction of the firing pin 30, the tip 38 is pushed into percussion primer material 50 causing same to be ignited. The combustion output of the material 50 flashes through the third bore region 18 and into the core 72 thereby igniting the slug 70. As the slug 70 burns, the resulting molten metallic reaction products melt the weakened region(s) of the closed end 64 and is available for contact with the fuel rods or wires (not shown) of the torch rod 100. With the core 72 diverging in dimension, the energy of the molten metallic reaction products are directed toward the closed end 64 instead of burning omni-directionally within the slug 70.

The advantages of the present invention are numerous. The igniter requires no electrical input and is completely waterproof. The pressed pyrotechnic material is reliable, is easily ignited, is non-toxic, produces little reaction gas, and produces substantial amounts of molten metallic reaction products required to start a torch rod's exothermic reaction. When an electrically conductive material is used for the igniter's housing, the igniter is not susceptible to ignition by electrostatic discharge as the housing acts as a Faraday cage.

Although the present invention has been described relative to specific embodiments, it is not so limited. For example, the igniter 10 could use a variety of different primer and/or pyrotechnic materials without departing from the scope of the present invention. The igniter 10 could also be formed as an integral part of a torch rod. Still further, the slug 70 could be pressed using different pressures along the length thereof in order to customize its burn profile. For example, a lesser pressure could be used at the end of the slug 70 nearest the third bore region 18 in order to enhance ignition reliability at temperature extremes.

Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. An igniter comprising:

a housing having a first end and a second end, said housing bored continuously there through to define, in succession, a first bore region that begins at said first end, a second bore region, a third bore region, and a fourth bore region that terminates at said second end;

a firing pin slidingly fit in said first bore region and extending from said first end of said housing, said firing pin terminating in a tip that protrudes into said second bore region when said firing pin is fully seated in said first bore region;

a primer press-fit in said second bore region;

a cup having an open end and a closed end, said cup fitted substantially in and sealed to said fourth bore region with said closed end substantially coincident with said second end of said housing, said closed end being structurally weakened at a portion thereof; and a slug of pyrotechnic material fitted in said cup, said slug having a bore formed continuously there through and substantially centrally aligned with said third bore region, said pyrotechnic material converting at least partially to molten metallic reaction products upon ignition.

2. The igniter in accordance with claim 1 further comprising means for locking said firing pin to said housing wherein said tip is maintained in a spaced apart relationship with said primer.

3. The igniter in accordance with claim 2 wherein said means for locking comprises a removable pin engaging said housing and said firing pin when said tip is maintained in a spaced apart relationship with said primer.

4. The igniter in accordance with claim 1 wherein said housing further defines at least one annular channel formed on the exterior thereof.

5. The igniter in accordance with claim 4 further comprising an o-ring seal disposed in at least one said annular channel.

6. The igniter in accordance with claim 1 wherein said cup is made from aluminum.

7. The igniter in accordance with claim 1 wherein said portion of said closed end is reduced in thickness relative to a remainder of said closed end.

8. The igniter in accordance with claim 1 wherein said bore increases in diameter between said open end and said closed end of said cup.

9. The igniter in accordance with claim 1 wherein said pyrotechnic material comprises approximately 48.0 weight percent iron oxide, approximately 31.3 weight percent titanium, approximately 17.6 weight percent zirconium, and approximately 2.9 weight percent of a binder.

10. The igniter in accordance with claim 1 further comprising an o-ring disposed about said firing pin and in sealing contact with said first bore region.

11. An igniter comprising:

a housing having a first end and a second end, said housing bored continuously there through to define, in succession, a first bore region that begins at said first end, a second bore region having a smaller diameter than said first bore region, a third bore region having a smaller diameter than said second bore region, and a fourth bore region having a larger diameter than said third bore region and that terminates at said second end, said housing further having an exterior region adapted to facilitate coupling to an exothermic torch rod;

a firing pin slidingly fit in said first bore region and extending from said first end of said housing, said firing pin terminating in a tip that protrudes into said second bore region when said firing pin is fully seated in said first bore region;

a percussion primer press-fit in said second bore region;

an aluminum cup having an open end and a closed end, said cup fitted substantially in and sealed to said fourth bore region with said closed end substantially coincident with said second end of said housing, said closed end being structurally weakened at a portion thereof; and a slug of pressed pyrotechnic material fitted in said cup, said slug having a bore formed continuously there through and substantially centrally aligned with said third bore region, said pressed pyrotechnic material converting at least partially to molten metallic reaction products upon ignition.

12. The igniter in accordance with claim 11 further comprising means for locking said firing pin to said housing wherein said tip is maintained in a spaced apart relationship with said primer.

13. The igniter in accordance with claim 11 wherein said exterior region comprises at least one open annular channel.

14. The igniter in accordance with claim 13 further comprising an o-ring seal disposed in each said open annular channel.

15. The igniter in accordance with claim 11 wherein said bore through said slug is formed as a divergent nozzle terminating at said closed end of said cup.

16. The igniter in accordance with claim 11 wherein said pressed pyrotechnic material comprises approximately 48.0 weight percent iron oxide, approximately 31.3 weight percent titanium, approximately 17.6 weight percent zirconium, and approximately 2.9 weight percent of a binder.

17. An igniter comprising:

a housing having a first end and a second end, said housing bored continuously there through to define, in succession, a first bore region that begins at said first end, a second bore region having a smaller diameter than said first bore region, a third bore region having a smaller diameter than said second bore region, and a fourth bore region having a larger diameter than said third bore region and that terminates at said second end, said housing further defining a plurality of open annular channels on an exterior thereof;

a firing pin slidingly and sealingly fit in said first bore region and extending from said first end of said housing, said firing pin terminating in a tip that protrudes into said second bore region when said firing pin is fully seated in said first bore region;

a percussion primer press-fit in said second bore region;

an aluminum cup having an open end and a closed end, said cup fitted substantially in and sealed to said fourth bore region with said closed end substantially coincident with said second end of said housing, said closed end being structurally weakened at a portion thereof; and a slug of pressed pyrotechnic material fitted in said cup, said slug having a diverging-diameter bore formed continuously there through and substantially centrally aligned with said third bore region, said pressed pyrotechnic material comprising approximately 48.0 weight percent iron oxide, approximately 31.3 weight percent titanium, approximately 17.6 weight percent zirconium, and approximately 2.9 weight percent of a binder.

18. The igniter in accordance with claim 17 further comprising means for locking said firing pin to said housing wherein said tip is maintained in a spaced apart relationship with said primer.

19. The igniter in accordance with claim 18 further comprising an o-ring seal disposed in at least one said open annular channel.

* * * * *